United States Patent [19]

Lind et al.

[11] Patent Number: 4,587,192

[45] Date of Patent: May 6, 1986

[54] DEVELOPING APPARATUS FOR THE LIQUID DEVELOPMENT OF ELECTROSTATIC CHARGE IMAGES

[75] Inventors: Erwin Lind, Wiesbaden; Helmuth Haberhauer, Taunnusstein, both of Fed. Rep. of Germany

[73] Assignee: Hoechst Aktiengesellschaft, Frankfurt am Main, Fed. Rep. of Germany

[21] Appl. No.: 639,029

[22] Filed: Aug. 9, 1984

[30] Foreign Application Priority Data

Aug. 16, 1983 [DE] Fed. Rep. of Germany ..... 3329451

[51] Int. Cl.[4] ..... B05B 5/00; G03G 13/10; G03G 15/06; G03G 15/10

[52] U.S. Cl. ..... 430/117; 118/638; 118/647; 118/649; 118/651; 118/659; 355/3 DD; 430/102; 430/119

[58] Field of Search ..... 430/102, 119, 117; 118/647, 649, 651, 659, 638; 355/3 DD

[56] References Cited

U.S. PATENT DOCUMENTS

| | | | |
|---|---|---|---|
| 2,784,694 | 3/1957 | Crumrine et al. | 118/51 |
| 3,232,190 | 2/1966 | Willmott | 95/1.7 |
| 3,405,682 | 10/1968 | King et al. | 116/649 |
| 3,613,636 | 10/1971 | Soures | 118/637 |
| 3,663,219 | 5/1972 | Takahashi | 430/119 |
| 3,741,760 | 6/1973 | Snelling | 118/647 X |
| 3,750,624 | 8/1973 | Sato et al. | 118/651 X |
| 3,776,723 | 12/1973 | Royka et al. | 430/102 |
| 3,783,826 | 1/1974 | Urbanek et al. | 118/647 X |
| 3,952,700 | 4/1976 | Little, Jr. et al. | 118/651 |
| 3,998,185 | 12/1976 | Weiler | 118/651 |
| 4,021,586 | 5/1977 | Matkan | 427/17 |
| 4,073,266 | 2/1978 | Arneth et al. | 118/647 |

FOREIGN PATENT DOCUMENTS

| | | |
|---|---|---|
| 1271547 | 4/1961 | Fed. Rep. of Germany . |
| 2149889 | 4/1972 | Fed. Rep. of Germany . |
| 2138254 | 3/1973 | Fed. Rep. of Germany . |
| 2332253 | 1/1975 | Fed. Rep. of Germany . |
| 2507221 | 9/1976 | Fed. Rep. of Germany . |

OTHER PUBLICATIONS

German Patentschrift No. 92 858 filed 7/26/71: European Search Report.

*Primary Examiner*—John E. Kittle
*Assistant Examiner*—Mukund J. Shah
*Attorney, Agent, or Firm*—Schwartz, Jeffery, Schwaab, Mack, Blumenthal & Evans

[57] ABSTRACT

Disclosed is a developing apparatus and process for the liquid development of electrostatic charge images on an image carrier material. The developing apparatus includes a device for spraying a liquid developer onto the image carrier material to be developed, and a developing electrode connected to a direct-current voltage source. The developing electrode comprises an electrically conductive web positioned in operative relationship to the image carrier layer, the web is unwound from a supply roll and wound up on a take-up roll, the distance of the web-shaped developing electrode from the surface of the image carrier material being adjustable by means of at least one guide roll.

18 Claims, 2 Drawing Figures

DEVELOPING APPARATUS FOR THE LIQUID DEVELOPMENT OF ELECTROSTATIC CHARGE IMAGES

BACKGROUND OF THE INVENTION

The present invention relates to a developing apparatus and process for the liquid development of electrostatic charge images on an image carrier material. The apparatus includes a device for spraying a liquid developer onto the image carrier material to be developed and a developing electrode connected to a direct-current voltage source.

An apparatus of this type for the development of an electrostatic charge image electrophotographic copying material is described in German Pat. No. 2,507,221 corresponding to U.S. Pat. No. 4,073,266. This apparatus is equipped with a pair of feeding rollers for applying to a copier material a toner dispersion, as well as with a distributor roller for evenly distributing the toner dispersion on the charge image. The spray pipe for spraying the toner dispersion is fitted above the distributor roller and has series of nozzles in its pipe jacket arranged symmetrically to the vertical center line of the spray pipe. The voltage applied to the distributor roller is at least as great as the charge level at the non-image area of the charge image and no greater than the charge level at the image points of a full-tone area of the charge image. The voltage applied to the distributor roller is preferably in the range between about 20 and 350 volts. The distributor roller operates as a back electrode or developing electrode and the toner deposited on the surface of the distributor roller is rinsed off by spraying with the toner dispersion. The toner runs into a collecting tray to be reused.

German Offenlegungsschrift No. 2,138,254 describes an electrophotographic reverse developing apparatus having one or more developing electrode rolls carrying a bias voltage of the same polarity as the charge image to be developed and equipped with devices for supplying toner dispersion to the developing electrode rolls. The developing electrode rolls are not in direct contact with the copying material and the toner particles of the toner dispersion have the same polarity as the charge image. The liquid developer is applied directly to the developing electrode rolls and then is passed from the developing electrode rolls to the recording carrier. Arranged underneath the recording carrier are conductive rolls, which support the underside of the recording carrier. The conductive rolls are cleaned by means of flexible brushes.

German Offenlegungsschrift No. 2,332,253 discloses a developing apparatus for an electrophotographic copying material which passes, in a developing zone, under applicator rollers which are wetted from above with a toner dispersion. In this way, a film of the toner dispersion is applied to the copying material. At the end of the developing zone, there is a pair of squeeze rollers which, by squeezing the copying material, remove excessive toner dispersion from the surface of the copying material.

German Auslegeschrift No. 2,149,889 discloses a developing apparatus which has a roller or a continuous circulating web as an applicator element for applying the liquid toner to a recording material bearing charge images. At a point on the path of movement of the applicator element between emergence from the developer bath and application to the recording material, there is a device for reducing the amount of liquid carried along by the toner deposited on the applicator element. This device can be a corona discharge electrode. Excess toner, or toner left behind on the applicator element, is removed after development by means of a wiper blade, a rotating brush or other devices.

A disadvantage common to the known developing apparatus is that the toner supply is not applied evenly under all conditions. In particular, the reproduction of full tone areas, which must be covered homogeneously with toner, the background-free reproduction of non-image areas and, especially, the reproduction of screen images faithful to tonal values on the recording materials leaves something to be desired.

In the case of many photoconductor layers used in practice, complete discharge by exposure is difficult. In practice, charges still remain even at non-image points exposed to the light. The potential remaining on the surfaces of photoconductor layers following exposure can be 50 to 100 volts and more. This behavior of the photoconductor layers is attributable to the strong dependency of the motion of charge carriers generated by light on the prevailing field strength.

As already mentioned in conjunction with the state of the art, briefly described above, in order to reproduce solid areas homogeneously covered with toner, so-called back electrodes or developing electrodes in the form of rolls, rollers or plates are utilized, the shapes of which are adapted to the particular recording carrier to be developed. However, when using such electrodes, the residual charges remaining at non-image areas are included in developing so that the developed images are not background free. It is therefore necessary to apply a counter voltage to the developing electrodes to compensate for the charges on the photoconductor layer. It is only by this means that the development of fully background-free images is made possible. However, the application of a voltage to the developing electrode causes the deposition of toner on the electrode, reducing its efficiency very rapidly. Since, however, it is essential that developing conditions remain constant specifically in the case of screen reproductions faithful to tonal values, this means that the developing electrode must constantly be cleaned, simple general rinsing not being enough. Additional mechanical or electrical forces must be used to remove the toner adhering to the developing electrode. This cleaning process requires a great deal of equipment and time. Disposal of the toner washed off or mechanically removed also requires considerable effort.

SUMMARY OF THE INVENTION

It is therefore an object of the present invention to provide a developing apparatus for the high-quality liquid development of electrostatic charge images of consistent image quality without requiring cleaning of the developing electrode used in the development.

Another object of the present invention is the provision of a developing apparatus of the type described above which develops background-free images.

Thus, in accordance with one aspect of the present invention, there has been provided a developing apparatus for the liquid development of electrostatic charge images on an image carrier material, comprising a base over which the image carrier material is transported, a device for spraying a liquid developer onto the image carrier material to be developed, a developing electrode connected to a direct-current voltage source comprising an electrically conductive web, and at least one guide roll for adjusting the distance between the electrically conductive web and the image carrier material and for passing the electrically conductive web in relation to the image carrier material.

In accordance with another aspect of the present invention, there has been provided a process for the liquid development of electrostatic charge images on an image carrier material, comprising the steps of passing an image carrier material over a base, passing a developing electrode comprising an electrically conductive web in relation to the image carrier material, wherein the web is transported from a supply roll over at least one adjustable guide roll to a take-up roll, adjusting the position of the at least one guide roll to vary the distance between the web and the image carrier material.

Further objects, features and advantages of the present invention will become apparent from the detailed description of preferred embodiments which follows when considered together with the figures of drawing.

DETAILED DESCRIPTION OF PREFERRED EMBODIMENTS

The developing apparatus of the present invention provides for high quality liquid development of electrostatic charge images of consistent image quality without requiring cleaning of the developing electrode used in the development. This is achieved by a developing electrode comprising an electrically conductive web, which is unwound from the supply roll and wound onto a take-up roll, and by adjusting the distance between the web-shaped developing electrode and the surface of the image carrier material by means of at least one guide roll, via which the web-shaped developing electrode is passed.

In one embodiment of the invention, the developing electrode is connected to a variable direct-current voltage source and one of the poles of the direct-current voltage source is connected to the base over which the image carriage material is moved.

In another embodiment of the invention, the take-up roll is connected to a variable direct-current voltage source.

The web-shaped electrode/strip electrode is guided with the aid of one or more rolls. For example, the web-shaped developing electrode is passed via two adjustable guide rollers upstream of the spray pipe for the liquid developer and two adjustable guide rolls downstream of the spray pipe. It is advisable in this embodiment to pass the web-shaped developing electrode over a deflection roll, which is located above the spray pipe. Depending on the number of guide rolls used, a greater or lesser electrode surface results, so that adaption to the properties of the liquid developer and to the process parameters, such as, for example, developing speed, is easily possible. By adjusting the guide rolls, the distance of the developing electrode from the surface of the image carrier can be adjusted with great accuracy.

Possible web materials for the developing electrode include thin metal foils, for example, of aluminum, which are bright rolled, surface roughened or provided with a high-resistivity coating. Likewise, vaporized metal-coated or metal-clad plastic films or papers can be used.

The present invention achieves the advantage that halftone dots are reproduced with constantly faithful tonal values, full-tone areas are developed homogeneously and image-free points are reproduced without background, since there is always a developing electrode available with no toner deposition on its surface facing the image carrier to compensate for the residual charge.

Figure 1:
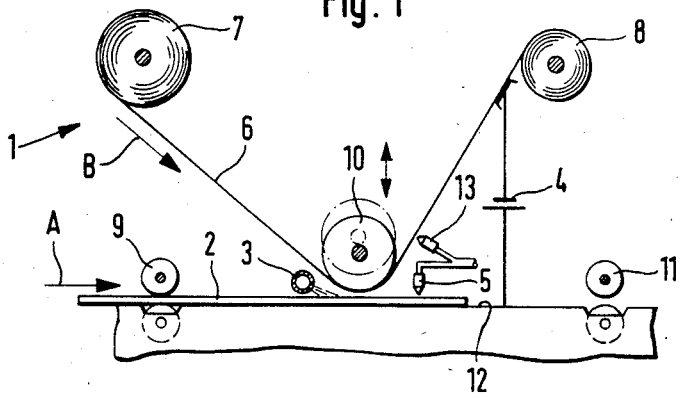
FIG. 1 is a diagrammatic representation of one embodiment of the developing apparatus according to the present invention.

Turning now to the Figures, a developing apparatus 1 according to the present invention is shown diagrammatically in FIG. 1. This developing apparatus 1 has a base 12 horizontally positioned on which the image carrier material to be developed 2, for example, a printing plate, rests or is transported. The image carrier or copying material 2 comprises an electrically conductive carrier layer with an electrophotographic recording layer applied thereto. The recording layer is electrostatically charged homogeneously in a known way with a corona charge device. Subsequently, the charged recording layer, in contact with the image of an original, is episcopicaly or diascopically exposed from an original. The latent electrostatic charge image produced in this manner is developed in the developing apparatus 1 with liquid toner comprising toner particles dispersed in a liquid.

At the beginning and end of the developing apparatus 1 are arranged a pair of feeding rollers 9 and a pair of transport rollers 11, respectively.

The image carrier material to be developed 2 having the recording layer bearing the electrostatic charge image is brought up over the base 12 into the gap between the pair of feeding rollers 9, is taken up by these rollers and is transported in the direction of arrow A through the developing apparatus 1.

In the vicinity of the center of the base 12 is a spray pipe 3, which comprises a series of nozzles arranged on the pipe circumference at an angle of between about 5° and 15° to the center perpendicular. This angle arrangement, which is known, ensures a particularly even distribution of the liquid film on the recording layer of the image carrier material 2. Instead of the spray pipe, a slot nozzle or other applicator device may be provided.

Arranged above the pair of feeding rollers 9 is a supply roll 7 for holding a web-shaped developing electrode 6. The web-shaped developing electrode 6 is an electrically conductive web which is unwound from the supply roll 7 and passed via a guide roll 10 to a take-up roll 8, which is located at about the same height above the base 12 as the supply roll 7. The distance of the web-shaped developing electrode 6 from the surface of the image carrier material 2 is adjusted by means of the guide roll 10, the shaft of which is adjustable within a range of about 1 to 3 mm by means not illustrated in the figures. The web-shaped developing electrode 6 is advantageously unwound from the supply roll 7 and wound onto the take-up roll 8 at the same speed as the transporting rate of the image carrier material 2. This mode of operation of the developing apparatus 1 is only intended when particularly high requirements are made on the development and reproduction of screened images. If the requirements on the image quality are somewhat lower, it suffices if the web-shaped developing electrode is stationary during transport of the image carrier material 2 and several printing plates, for example, about 5 to 10, are developed with a section of the developing electrode 6 of predetermined length, before the developing electrode 6 is repositioned by the predetermined length distance. With only about 5 to 10 developing processes being performed with the same web section of the developing electrode 6, soiling of the electrode by deposited toner is very limited. Usually, the developing electrode 6 is transported in the direction of arrow B from the supply roll 7 to the take-up roll 8. Of course, it is also possible to transport the developing electrode 6 in the reverse direction, i.e., from roll 8, which is then intended as the supply roll, to roll 7, which then acts as the take-up roll.

In the region of the guide roll 10, the distance between the web-shaped developing electrode 6 and the light-sensitive surface is from about 0.5 mm to 2 mm, with a distance of between about 1 mm and 1.5 mm being preferred. The thickness of the web-shaped developing electrode 6 is between about 20 to 100 μm, in particular about 50 μm, and up to about 300 m of the developing electrode 6 can be wound up on the supply roll 7. The strip material provided for the developing electrode 6 is generally a metal foil, in particular an aluminum foil. The surface of the developing electrode can be roughened, bright rolled or provided with a high-resistivity coating. The high-resistivity coating includes, for example, polystyrene or copolymers. The coating largely prevents a dielectric breakdown of the developing electrode 6.

In the case of the embodiment of the developing apparatus shown in FIG. 1, one pole of the variable direct-current voltage source 4 is in connection via a sliding contact, not shown, with the side of the developing electrode 6 facing the image carrier material 2. A direct-current voltage of up to about 200 volts is applied to the developing electrode 6.

Air nozzles 5 and 13 for drying the image carrier material 2 and the developing electrode 6 are arranged, in each case, at a distance of about 1 to 3 mm from the surface of the image carrier material 2 to be developed and from the side of the developing electrode 6 facing the image carrier material, respectively.

Instead of metal foils, vaporized metal-coated or metal-clad plastic films can be used. A vaporized metal-coated or metal-clad paper web is likewise suitable as the web material of the developing electrode.

Figure 2:
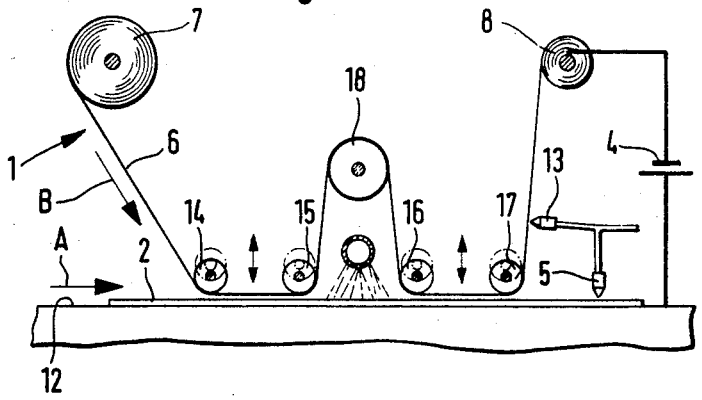
FIG. 2 is another embodiment of the developing apparatus according to the present invention.

In the case of the embodiment of the developing apparatus 1 shown diagrammatically in FIG. 2, several guide rolls 14 to 17 are provided, via which the web-shaped developing electrode 6 is passed. The same symbols are used for the components of this developing apparatus 1 which coincide with corresponding elements of the developing apparatus according to FIG. 1. The description of these components is not repeated. The web-shaped developing electrode 6 is moved from the supply roll 7 in the direction of arrow B via the two guide rolls 14 and 15, and also via a deflection roll 18 and the two guide rolls 16 and 17, to the take-up roll 8.

The guide rolls 14 to 17 are arranged at a distance of about 0.5 mm to 2 mm from the surface of the image carrier material 2. The distance of the guide rolls can be adjusted within the given range. The deflection roll 18 is arranged further away from the image carrier material 2, above the spray pipe 3.

In this embodiment of the developing apparatus 1, one pole of the variable direct-current voltage source 4 is connected to the roller core of the take-up roll 8, while the other pole is connected to the base 12, over which the image carrier material 2 is transported.

In this embodiment, the use of two guide rolls upstream of the spray pipe 3 and the deflection roll 18 and two guide rolls downstream of the spray pipe and deflection roll, seen in each case in the transporting direction A of the image carrier material 2, creates a larger electrode surface for development. This surface is determined by the distance between the guide rolls 14, 15, 16 and 17, respectively. Due to this larger electrode surface in comparison with the embodiment according to FIG. 1, a very accurate adaptation to the properties of the liquid developer used and to the process parameters, such as the developing speed, i.e., the transporting rate of the image carrier material 2 and the web-shaped developing electrode 6, is easily possible.

This invention involves the realization of a developing electrode which is completely free of toner deposits and thereby makes a reproduction faithful to tonal values and of consistent quality possible for all developed image carrier materials. Furthermore, no cleaning of the developing electrode is necessary during operation as the electrode is either thrown away after use or, if reused, can be cleaned in a single procedure. In view of the materials on the market used for this, the costs of such a developing electrode are low.

What is claimed is:

1. A developing apparatus for the liquid development of electrostatic charge images on an image carrier material, comprising:

a base over which the image carrier material is transported;

a device for spraying a liquid developer onto the image carrier material to be developed;

a developing electrode connected to a direct-current voltage source, said electrode comprising an electrically conductive web;

means for advancing the conductive web in relation to the image carrier material; and at least one guide roll means for adjusting the distance between said electrically conductive web and the image carrier material and for passing said electrically conductive web in relation to the image carrier material.

2. A developing apparatus as claimed in claim 1, further comprising a supply roll and a take-up roll for supplying and transporting said electrically conductive web.

3. A developing apparatus as claimed in claim 1, wherein said developing electrode is connected to a variable direct-current voltage source and wherein one pole of said direct-current voltage source is connected to said base.

4. A developing apparatus as claimed in claim 2, wherein said take-up roll is connected to a variable direct current voltage source.

5. A developing apparatus as claimed in claim 1, further comprising at least two adjustable guide rolls positioned upstream of said spraying device and at least two adjustable guide rolls positioned downstream of said spraying device.

6. A developing apparatus as claimed in claim 5, further comprising a deflection roll located above said spraying device and over which said electrically conductive web passes.

7. A developing apparatus as claimed in claim 1, further comprising at least two air nozzles, one of said nozzles for drying said developing electrode and the other of said nozzles for drying the image carrying material.

8. A developing apparatus as claimed in claim 7, wherein said at least two nozzles are positioned at a distance of about 1 to 3 mm from said developing electrode and the image carrier material.

9. A developing apparatus as claimed in claim 1, wherein said electrically conductive web material comprises a metal foil.

10. A developing apparatus as claimed in claim 9, wherein said metal foil comprises an aluminum foil.

11. A developing apparatus as claimed in claim 10, wherein said developing electrode includes a roughened, bright rolled or a high-resistivity surface.

12. A developing apparatus as claimed in claim 1, wherein said electrically conductive web material comprises a vaporized metal-coated or metal-clad plastic film.

13. A developing apparatus as claimed in claim 1, wherein said electrically conductive web material comprises a vaporized metal-coated or metal-clad paper sheet.

14. A developing apparatus as claimed in claim 1, wherein the distance between said developing electrode and the image carrier material ranges from about 0.5 to 2 mm.

15. A developing apparatus as claimed in claim 14, wherein the distance between said developing electrode and the image carrier material ranges from about 1 to 1.5 mm.

16. A developing apparatus as claimed in claim 1, wherein said electrically conductive web material has a thickness of from about 20 to 100 $\mu$m.

17. A developing apparatus as claimed in claim 16, wherein said electrically conductive web material has a thickness of about 50 $\mu$m.

18. A developing apparatus as claimed in claim 1, wherein said means for advancing the conductive web comprises a supply roll and a take-up roll between which the conductive web is provided, such that the conductive web is wound off the supply roll and wound up onto said take-up roll as it is advanced in relation to the image carrier material.

* * * * *